United States Patent [19]

Nishikawa

[11] 4,307,432

[45] Dec. 22, 1981

[54] CHARGE APPARATUS

[75] Inventor: Masaji Nishikawa, Hachioji, Japan

[73] Assignee: Olympus Optical Company Ltd., Tokyo, Japan

[21] Appl. No.: 84,556

[22] Filed: Oct. 15, 1979

[30] Foreign Application Priority Data

Dec. 20, 1978 [JP] Japan ..... 53-160323

[51] Int. Cl.[3] ..... H05F 3/02

[52] U.S. Cl. ..... 361/221; 361/214

[58] Field of Search ..... 361/212, 213, 214, 221

[56] References Cited

U.S. PATENT DOCUMENTS

| | | | |
|---|---|---|---|
| 1,275,585 | 8/1918 | Morgan et al. | 361/221 |
| 1,696,750 | 12/1928 | Brasseur | 361/221 |
| 1,940,536 | 12/1933 | Eyler | 361/214 X |
| 3,757,164 | 9/1973 | Binkowski | 361/221 X |

FOREIGN PATENT DOCUMENTS 52-6159 2/1977 Japan .

*Primary Examiner*—Harry E. Moose, Jr.

*Attorney, Agent, or Firm*—Weinstein & Sutton

[57] ABSTRACT

Charged neutralizer apparatus including a charge neutralizing brush which is formed thin conductive wires brought into proximity with a charged body to cause a discharge thereof is disclosed herein. A spacer member is provided to prevent direct contact between the thin conductive wires and the charged body and defines a narrow clearance therebetween. The brush is disposed in a movable manner and adapted to move under its own weight or by biasing means, in following relationship with the changed body to thus enable an elimination of charge at any position of the charged body.

10 Claims, 12 Drawing Figures

CHARGE APPARATUS

BACKGROUND OF THE INVENTION

The invention relates to a charge neutralizer, and more particularly, to such an apparatus including a charge neutralizing brush formed by thin, conductive wires and which is brought close to a charged body to cause a discharge thereof.

It is known to remove an electrostatic charge from a paper, cloth, plastic film or the like by using a charge neutralizing brush formed by thin conductive wires or a charge neutralizing fabric which is woven from thin conductive wires. This technique is in practical use, and is based on the so-called corona discharge phenomenon wherein a thin conductive wire is placed in proximity to a highly charged body to establish a sufficiently high electric field around an edge of the wire causing an ionization of gas and producing a discharge of the charged body.

An example of such charge neutralizer will be described below with reference to an electrophotographic apparatus which employs it. In electrophotography, a record sheet to which the image of an original is copied may be highly charged as a result of various electrical operations which take place during the copying cycle such as a image transfer, deposition of charged developing toner thereon and/or the friction of the record papers with each other or with mechanical parts. Hence, if copies produced from the copying apparatus are in a charged condition, a number of inconveniences may result. For instance, interference with a proper alignment and stacking of record papers as a result of a repelling effect between similarly charged sheets disposed on a tray may occur or an operator may receive an electric shock or experience the hairs on his body being attracted when placed near such charged copies. A charge neutralizer is used to prevent such inconveniences.

Referring to FIG. 1, there is shown a schematic view of a portion of electrophotographic apparatus 1 and in particular, the record or copy delivery portion thereof. A fixing unit 2 is shown to the leftmost of this Figure, and includes a delivery outlet 2*a*, adjacent to which are paper of delivery rollers 3*a*, 3*b*. The paper delivery rollers 3*a* and 3*b* are disposed for rotation on rotary shafts 9*a*, 9*b* so as to abut against each other with record paper 6 interposed therebetween. Charge neutralizing brush 4, which forms charge neutralizer 5, is disposed after these rollers in the path of paper flow, and a tray 7 is provided below the brush for receiving record papers 6 therein. As shown, brush 4 is fixedly mounted on a stationary member indicated by numeral 8. Fixing unit 2 is of a conventional heater type in which a toner image is thermally fixed. After the fixing step, record paper 6 is driven to the right, as viewed in FIG. 1, into the nip formed between rotating delivery rollers 3*a*, 3*b* to be carried into tray 7. As record paper 6 passes the charge neutralizer 5, any electrostatic charge which is carried by the record sheet is discharged, thus achieving a charge neutralization.

FIGS. 2A to C illustrate conventional charge neutralizing brushes. Brush 4A shown in FIG. 2A comprises a number of thin metal wires 41 of high electrical conductivity which are distributed in an array having a uniform density, so that their free ends are aligned. The opposite ends of the thin wires are held between folded limbs of metal sheet 42 which may be formed of aluminium or the like. Brush 4B shown in FIG. 2B comprises subassemblies of thin conductive wires 43 which are arranged in the manner of a comb and which have one end held between folded limbs of metal sheet 44 which may also be formed of aluminium. Brush 4C shown in FIG. 2C comprises charge neutralizing fabric 46 using thin conductive wires 45 as part of its warp and which has its one end held between folded limbs of metal sheet 47, again formed of aluminium or the like, with thin wires 45 projecting forwardly of the fabric. The thin conductive wires may also be formed by metal plated fibres or metal coated fibres, in addition to the metal wires.

FIG. 3 graphically shows the charge neutralizing effect of charge neutralizer 5. As shown, the charge neutralizing effect is significant when the distance d between record sheet 6 and the front end of brush 4 is reduced. When the front end of brush 4 contacts record sheet 6, or when the distance d is reduced to 0 mm or less, the brush is most effective. It is considered that the charge neutralizing effect is at its maximum when brush 4 contacts record sheet 6 because a flow of charge from record sheet 6 occurs through brush 4, in addition to that associated with the corona discharge effect.

It is to be noted that the charge neutralizing effect of charge neutralizer 5 depends not only on the distance d between record sheet 6 and brush 4, but also on the degree of contamination of brush 4. As indicated in FIG. 4, when brush 4 is not contaminated, the charged potential of the record sheet can be reduced from a charged level A to a low level B which is close to zero. However, when brush 4 is contaminated, the residual potential after the charge eliminating step will reside at a level C which is substantially more than the B level. Thus, as contamination of brush 4 substantially degrades the charge neutralizing or eliminating effect, it is undesirable that the front end of brush 4 be allowed to contact a charged record sheet 6 so that contamination from contact is minimized. Therefore, it will be seen that a lasting charge neutralizing effect cannot be maintained under conditions which provide an optimum charge eliminating effect. Specifically, if brush 4 is allowed to contact record sheet 6 to enhance the charged elimiating effect, any unfixed toner which remains due to an imperfect heating or pressure fixing action may be deposited on brush 4. Similarly toner in its softened condition from heat fixing may attach to brush 4, before it is sufficiently cooled, thus causing a rapid loss of the neutralizing ability of brush 4.

In addition, a conventional charge neutralizer 5 is disposed at a fixed location, so that brush 4 cannot be maintained in sufficient proximity to record sheet 6 to achieve a stabilized charge neutralizing effect if record sheet 6 is not perfectly planar or its delivery path varies. Thus, referring to FIG. 1, it will be noted that at the time the leading end of record sheet 6 has left delivery rollers 3*a*, 3*b*, it will assume a position indicated by a solid line while it will assume another position indicated by phantom line 6A which is more spaced from brush 4 when a greater length of record sheet 6 has left the delivery rollers. Hence, if brush 4 is located at a position which is preferred for eliminating charge from the leading portion of record sheet 6, the same brush will be less effective in eliminating charge from the trailing part of record sheet 6. Conversely, if the position of brush 4 is chosen so as to be optimum for eliminating the charge from the trailing part of record sheet 6, the delivery path of record sheet 6 will be such that the leading portion thereof will bear against brush 4 to interfere with the delivery operation of record sheet 6. Thus, it has been impossible to locate brush 4 so as to achieve an optimum charge neutralizing effect for both the leading and the trailing portions of the record sheet.

SUMMARY OF THE INVENTION

It is an object of the invention to provide a charge neutralizer which eliminates the described disadvantages of the prior art by preventing direct contact between a charge neutralizing brush and a charged body and allows the brush to track any positional change of the charged body to assure a satisfactory neutralizing of charge.

In accordance with the invention, a spacer member is disposed on a side of a charge neutralizing brush which is located adjacent to a charged body to thereby prevent direct contact of the brush with the charged body. The brush is movably mounted so as to permit it to track any change in the position of the charged body, to assure satisfactory charge elimination. Bias means is associated with the brush to enable a charge neutralizing operation irrespective of the direction in which the charged body is delivered or the condition of the surface from which the charge is to be eliminated.

DESCRIPTION OF PREFERRED EMBODIMENTS

Figure 1:
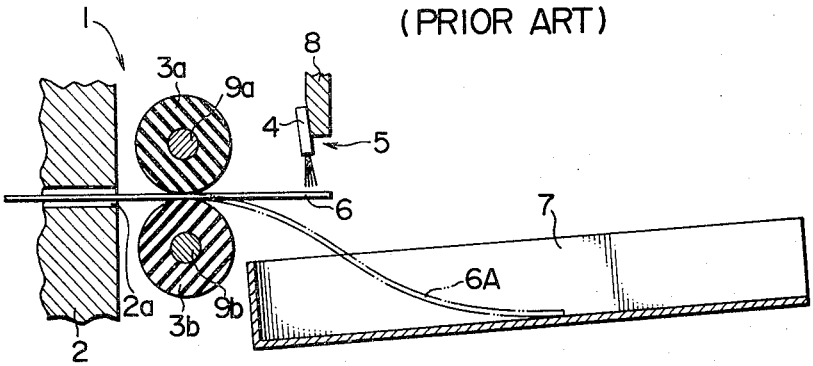
FIG. 1 (PRIOR ART)
FIG. 1 is a schematic cross section of an electrophotographic apparatus incorporating a conventional charge neutralizer.
Figure 2A:
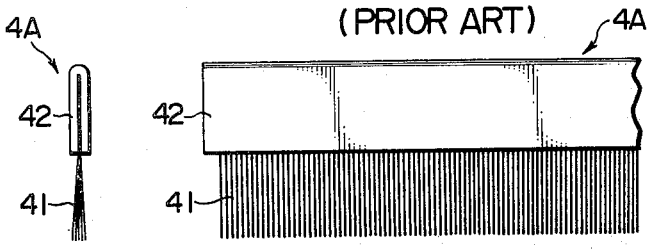
FIG. 2(A) (PRIOR ART)
FIGS. 2A to C are side elevations and associated front views of several examples of charge neutralizing brushes used in the prior art.
Figure 2B:
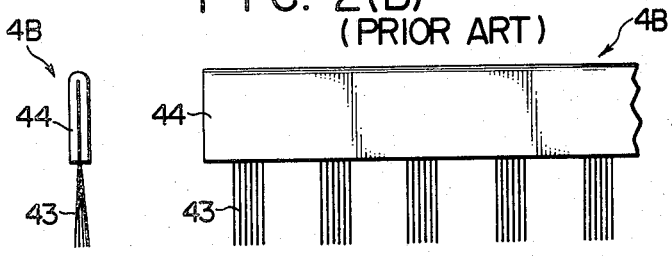
FIG. 2(B) (PRIOR ART)
Figure 2C:
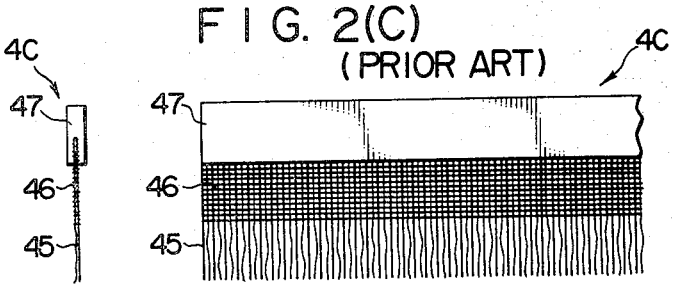
FIG. 2(C) (PRIOR ART)
Figure 3:
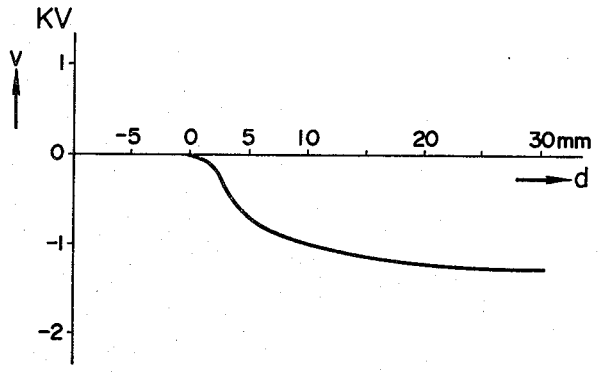
FIG. 3 graphically shows the charge neutralizing effect plotted against the distance between the charge neutralizing brush and the charged body.
Figure 4:
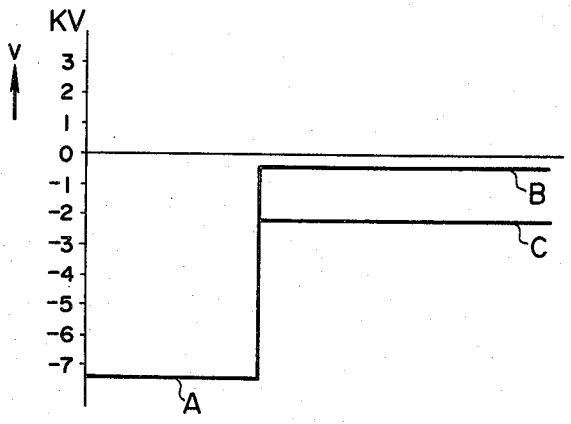
FIG. 4 graphically illustrates a variation in the charge neutralizing effect which may be caused by a contamination of the charge neutralizing brush.
Figure 5:
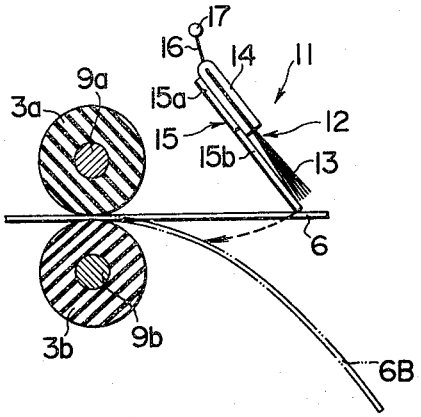
FIG. 5 is a schematic side elevation, partly in section, of a charge neutralizer according to one embodiment of the invention.

Referring to FIG. 5, there is shown a charge neutralizer 11 according to one embodiment of the invention, used in combination with an electrophotographic apparatus. Neutralizer 11 comprises charge neutralizing brush 12 which is fastened to one end of suspender 16 formed of a flexible material such as yarn or string, the other end of which is secured to fixed point 17 on the electrophotographic apparatus.

Figure 6:
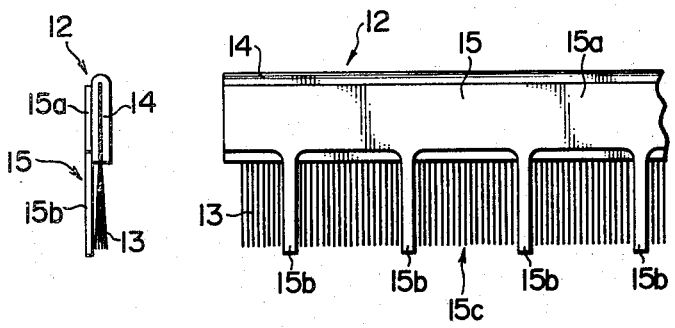
FIG. 6 is a side elevation and a front view of a charge neutralizing brush which is used in the apparatus shown in FIG. 5.

As shown in FIG. 6, brush 12 comprises a number of thin metal wires 13 of a high electrical conductivity which are distributed in substantially uniform density and which have their free end aligned on a common line. Holder plate 14 formed of a metal such as aluminium is centrally folded to provide a pair of limbs between which the opposite end of the wires is held. Spacer member 15 is secured to one side of holder plate 14. Spacer member 15 includes transversely elongate strip portion 15*a*, and a plurality of spaced, narrow spacers 15*b* which depend downwardly from the lower end face of strip portion 15*a*. Cutouts 15*c* of a greater spacing than the width of each spacer 15*b* are defined between these spacers.

The free end of spacers 15*b* project slightly beyond the free end of thin wires 13 so as to maintain the free end of thin wires 13 at a spacing from the surface of record sheet 6 which is on the order of 0.5 to 2 mm.

The cutouts 15*c* need not be so deep as to reach the lower edge of holder plate 14, but may be sized such that the free end of thin wires 13 be exposed for a length of several millimeters. The spacing between spacers 15*b* depends upon the evenness along the plane of the record sheet, with spacers 15*b* being more closely spaced when record sheet 6 is uneven. By experiments, it has been found that when a usual record sheet is used, a spacing on order of seven tenths of a millimeter is sufficient for the spacer members 15*b*. It is to be noted that the spacer member 15 may be formed of conductive or non-conductive material. Brush 12 is disposed so that spacer member 15 is closer to delivery rollers 3*a*, 3*b* than holder plate 14.

In operation, the record sheet 6 which has been subjected to a fixing operation is from delivery rollers 3*a*, 3*b*. The leading end of record sheet 6 bears against the lower end of spacer member 15 which assumes a vertical position as a result of its own gravity, thus rocking it counter-clockwise. At this time, the free end of spacers 15*b* abuts against the upper surface of record sheet 6 to prevent a direct contact between the thin wires 13 and record sheet 6 and maintains a spacing on the order of 0.5 to 2 mm therebetween. This allows corona discharge to occur between record sheet 6 and thin wires 13, thus eliminating charge from the surface of record sheet 6.

As record sheet 6 continues to be fed forward, the flexibility and the weight of record sheet 6 causes its delivery path to vary as indicated by phantom line 6B. Charge neutralizing brush 12 then returns toward its vertical position, maintaining a reduced spacing between the free end of thin wires 13 and the surface of record sheet 6 in tracking relationship with the latter. In this manner, it is assured that successive regions of the surface of record sheet 6 are neutralized by the charge neutralizing brush 12. Hence, a satisfactory charge neutralizing effect is maintained over a prolonged period of time.

Figure 7:
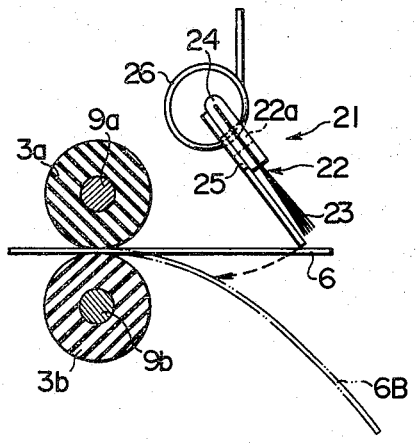
FIGS. 7 to 9 are side elevations, partly in section, of charge neutralizers according to other embodiments of the invention.

FIG. 7 shows another embodiment of the invention. In this embodiment, charge neutralizer 21 includes a charge neutralizing brush 22 having a plurality of openings 22*a* formed in holder plate 24 and spacer member 25, both of which are constructed in the same manner as holder plate 14 and spacer member 15 of FIG. 6. Ring-shaped support member 26 is passed through the openings 22*a* of the brush to support it in a movable manner. The support member 16 is formed of a metal wire or the like having a reduced diameter, and has its one end secured to a stationary member, not shown, of an electrophotographic apparatus.

The operation of charge neutralizer 21 is similar to that of charge neutralizer 11 mentioned above. Specifically, brush 22 is displaced to a position which is inclined from the vertical as it is urged by the leading end of record sheet 6, but is urged by its own weight to follow a change in the position of record sheet 6, thus maintaining a given spacing between thin wires 23 and record sheet 6 to eliminate charge from successivve surface areas of record sheet 6.

A similar effect can be achieved by using a U-shaped member for support member 26. It should also be understood that the support means comprising support member 26 and openings 22*a* may be replaced by any other pivotal means which rotatably support brush 22.

In certain circumstances, it may be impossible to move the free end of charge neutralizing brushes 12 and 22 to displace in a following relationship with changes in the position of record sheet 6 as in the described arrangements of FIGS. 5 and 7 depending on the position or the direction of delivery of record sheet 6. By way of example, such movement will be impossible where record sheet 6 moves in a vertical plane or where the charge on the lower surface of horizontally running record sheet 6 is to be eliminated. In this instance, the charge neutralizing brush may be disposed in a rotatable manner and urged by a spring or the like so that the forward end of a spacer member contained in the brush will be maintained in abutment against record sheet 6.

Figure 8:
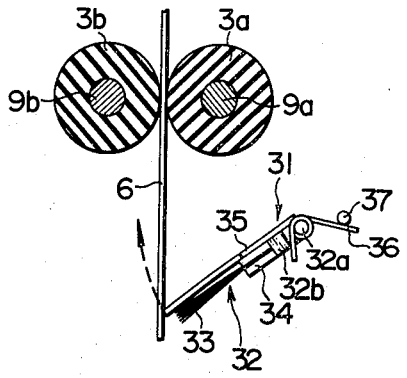

FIG. 8 shows a further embodiment of the invention in which the charge on a record sheet being displaced in a vertical plane may be eliminated. Charge neutralizer 31 of this embodiment includes charge neutralizing brush 32 which is formed by thin metal wires 33 having high electric conductivity, holder plate 34 and spacer member 35, all constructed in the same manner as charge neutralizing brush 12 shown in FIG. 6. At its top end, the opposite sides of holder plate 34 are rotatably mounted on pins 32*a* which are fixedly mounted on a stationary member, not shown. Charge neutralizer 31 also includes a torsion spring 36 having its one end anchored to detent 32*b* formed centrally on holder plate 34 and its other end abutting against detent pin 37 fixedly mounted on a stationary member, not shown, of an electrophotographic apparatus. Spring 36 is also mounted on pin 32*a*, and urges charge neutralizing brush 32 to rotate clockwise.

Charge neutralizer 31 operates substantially in the same manner as the charge neutralizer 11, 21 described above. Specifically, as record sheet 6 is fed through the nip between delivery rollers 3*a*, 3*b*, brush 32 which has been maintained in its free position, as urged by spring 36, is driven back by the leading end of record sheet 6. However, because brush 32 is constantly urged by spring 36, it moves in following relationship with a change in the position of record sheet 6 to maintain a given spacing between thin wires 33 and record sheet 6 to eliminate the change from successive surface areas of record sheet 6.

Figure 9:
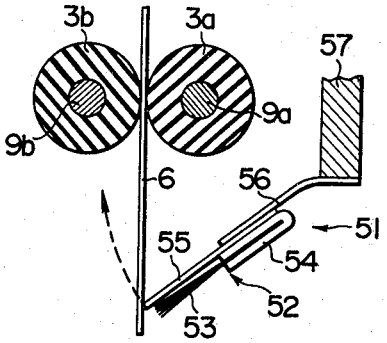

FIG. 9 shows an additional embodiment of the invention. In this embodiment, charge neutralizer 51 includes charge neutralizing brush 52, and leaf spring 56 having its one end secured to a side of the brush adjacent to its upper end and its other end anchored to stationary member 57 of an electrophotographic apparatus. Brush 52 includes thin metal wires 53 of high electric conductivity, holder plate 54 and spacer member 55, all constructed in the same manner as charge neutralizing brush 12 shown in FIG. 6. Leaf spring 56 is secured to a side of spacer member 55 which is opposite from the side where it is fixedly connected with holder plate 54.

The operation of charge neutralizer 51 is similar to that of charge neutralizer 41 described above. Thus, charge neutralizing brush 52 is biased forward by the resilience of leaf spring 56, but is displaced to a retracted position as the leading end of record sheet 6 bears against it.

However, the resilience of leaf spring 56 causes the brush to move in following relationship with a change in the position of record sheet 6 to maintain a given spacing between thin wires 53 and record sheet 6, thus eliminating the charge from successive surface areas of record sheet 6.

Figure 10:
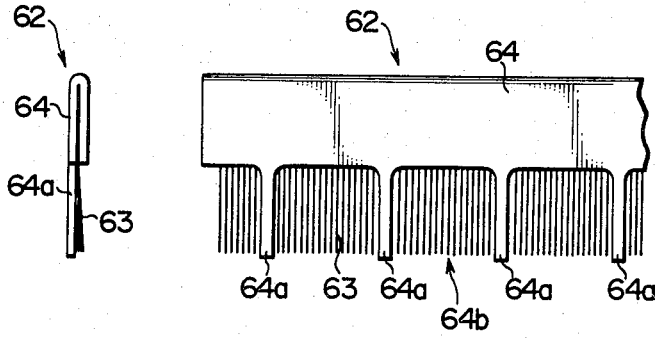
FIG. 10 is a side elevation and a front view of another form of charge neutralizing brush.

FIG. 10 shows another form of charge neutralizing brush which may be used in the charge neutralizer of the invention. Charge neutralizing brush 62 shown is similar to charge neutralizing brush 12 shown in FIG. 6 except that a spacer member 15 additionally provides the function of the holder member 14 which is omitted. The spacers 64*a* are thus integrally formed on one limb of holder plate 64. As before, thin metal wires 63 of high electric conductivity are held between both limbs of the holder plate. One limb of holder plate 64 is sized to have an increased surface area with respect to the other limb so that its lower edge projects slightly beyond the front end of thin wires 63, with notches 64*b* formed in the lower edge and separated by spacers 64*a*. It will be appreciated that such a construction of brush 62 simplifies the manufacture of the charge neutralizing brush. It should be understood that brush 62 can be used in any embodiment of the charge neutralizer shown in FIGS. 5, 7, 8 and 9.

While the invention has been described above as applied to an electrophotographic apparatus, it should be understood that the charge neutralizer of the invention is equally applicable to any arrangement in which it is desired to remove or eliminate a charge from a charged body by bringing a charge neutralizing brush into a proximate relationship therewith. In addition, it should be understood that the charge neutralizer brush of the present invention is highly effective and need not be positively connected to ground. However, it will be understood that the brush may be connected with the ground if desired.

What is claimed is:

1. In charge neutralizer apparatus including a charge neutralizing brush having a plurality of extending thin conductive wires to be brought into a proximate relationship with a charged body being displaced in a feed path to cause a discharge thereof; the improvement comprising spacer means disposed adjacent to said charge neutralizing brush intermediate said charge neutralizing brush and said feed path, said spacer means for preventing direct contact between the thin conductive wires of said neutralizing brush and said charged body being displaced thereby, and movable support means for displaceably mounting said charge neutralizing brush so that said brush is movable to track and follow the movement of said charged body being displaced in said feed path.

2. The charge neutralizer apparatus according to claim 1 wherein said spacer means includes a mounting portion fixedly secured to said neutralizing brush, and a plurality of depending spacer members extending from said mounting portion and disposed to contact a charged body being displaced in said feed path, said spacer members defining a narrow clearance between a charged body being displaced and said thin conductive wires.

3. The charge neutralizer apparatus according to claim 2 wherein said plurality of spacer members have free end portions located in substantial alignment with one another and project beyond said thin conductive wires toward said feed path.

4. The charge neutralizer apparatus according to claim 1 wherein said spacer means includes a retaining portion in which end portions of said plurality of thin conductive wires are secured.

5. The charge neutralizer apparatus according to claim 1 wherein said charge neutralizing brush which is displaceably mounted upon said support means is displaceable under its own weight, in a following relationship with a charged body present in said feed path.

6. The charge neutralizer apparatus according to claim 5 wherein said support means comprises flexible, string-like material connected between said neutralizing brush and a stationary member.

7. The charge neutralizer apparatus according to claim 5 wherein said support means comprises a curvilinear, filamentary member loosely fitted through an opening formed in said charge neutralizing brush.

8. The charge neutralizer apparatus according to claim 1 wherein said charged-body changes position as it is displaced in said feed path and said charge neutralizing brush is pivotably mounted upon said support means and is urged toward a following relationship with said charged body.

9. The charge neutralizer apparatus according to claim 8 wherein said support means comprises pivots formed at opposite end faces of said charge neutralizing brush, and said charge neutralizing brush is torsionally spring biased about said pivots to move angularly in a following relationship with a a charged body being displaced in said feed path.

10. The charge neutralizer apparatus according to claim 8 wherein said support means comprises a leaf spring having a first end portion secured to said charge neutralizing brush and a second end portion secured to a stationary member, said leaf spring acting to urge said charge neutralizing brush in a following relationship with a charged body being displaced in said feed path.

* * * * *

UNITED STATES PATENT AND TRADEMARK OFFICE

CERTIFICATE OF CORRECTION

PATENT NO. : 4,307,432

DATED : December 23, 1981

INVENTOR(S) : Masaji Nishikawa

It is certified that error appears in the above—identified patent and that said Letters Patent is hereby corrected as shown below:

On The Title Page, item (54) should read -- CHARGE NEUTRALIZER APPARATUS --.

In the abstract, line 10, "changed" should read -- charged --.

Column 1, line 27, "a" should read -- an --.

Column 2, lines 44-45, "charged elimiating" should read -- charge eliminating --.

Column 4, line 60, "16" should read -- 26 --.

Column 5, line 52, "change" should read -- charge --.

Signed and Sealed this

*Twenty-second* Day of *June 1982*

[SEAL]

*Attest:*

GERALD J. MOSSINGHOFF

*Attesting Officer*

*Commissioner of Patents and Trademarks*